US007328523B2

(12) United States Patent
Vossoughi et al.

(10) Patent No.: US 7,328,523 B2
(45) Date of Patent: Feb. 12, 2008

(54) DRYING GLOVE

(76) Inventors: Behrouz Vossoughi, P.O. Box 49892, Los Angeles, CA (US) 90049; Patra Bashouki, P.O. Box 49892, Los Angeles, CA (US) 90049

( * ) Notice: Subject to any disclaimer, the term of this patent is extended or adjusted under 35 U.S.C. 154(b) by 19 days.

(21) Appl. No.: 11/204,641

(22) Filed: Aug. 15, 2005

(65) Prior Publication Data

US 2006/0032075 A1 Feb. 16, 2006

Related U.S. Application Data

(60) Provisional application No. 60/601,710, filed on Aug. 16, 2004.

(51) Int. Cl.
*F26B 19/00* (2006.01)

(52) U.S. Cl. ..... 34/90

(58) Field of Classification Search ..... 34/380, 34/381, 90, 95; 15/227; 2/160
See application file for complete search history.

(56) References Cited

U.S. PATENT DOCUMENTS 2,651,071 A 9/1953 Dyer et al.
4,545,841 A 10/1985 Jackrel
4,797,967 A * 1/1989 Lengers ..... 15/227
4,953,998 A * 9/1990 McCartherens ..... 401/7
5,473,789 A * 12/1995 Oster ..... 15/104.94
5,564,154 A * 10/1996 Cohn, III ..... 15/227
5,740,551 A 4/1998 Walker
5,956,770 A 9/1999 Dennis
6,275,995 B1 * 8/2001 Le Gette et al. ..... 2/160

OTHER PUBLICATIONS

International Search Report, Behrouz Vossoughi, Aug. 15, 2005, International Search Report of PCT Application PCT/US2005/029002, which is related to this application.
Written Opinion of the International Searching Authority, Behrouz Vossoughi, Aug. 15, 2005, Written Opinion of the International Searching Authority of PCT Application PCT/US2005/029002, which is related to this application.

* cited by examiner

*Primary Examiner*—S. Gravini

(57) ABSTRACT

Some embodiments of the invention provide a moisture absorbent hand-covering device that is in the form and shape of a glove for drying. In some embodiments, the drying glove of this invention has a first outer layer and a second inner layer. The outer layer comprises at least one layer of material with propensity to absorb at least one type of liquid. In some embodiments, the second inner layer comprises at least one layer of material with propensity to repel at least one type of liquid. The outer layer absorbs the liquid for the purpose of removing it. The inner layer resists passage of the liquid, and thus protects the hand of the user during operation. In some embodiments, the liquid absorbed is water, and the liquid repelled is water.

7 Claims, 10 Drawing Sheets

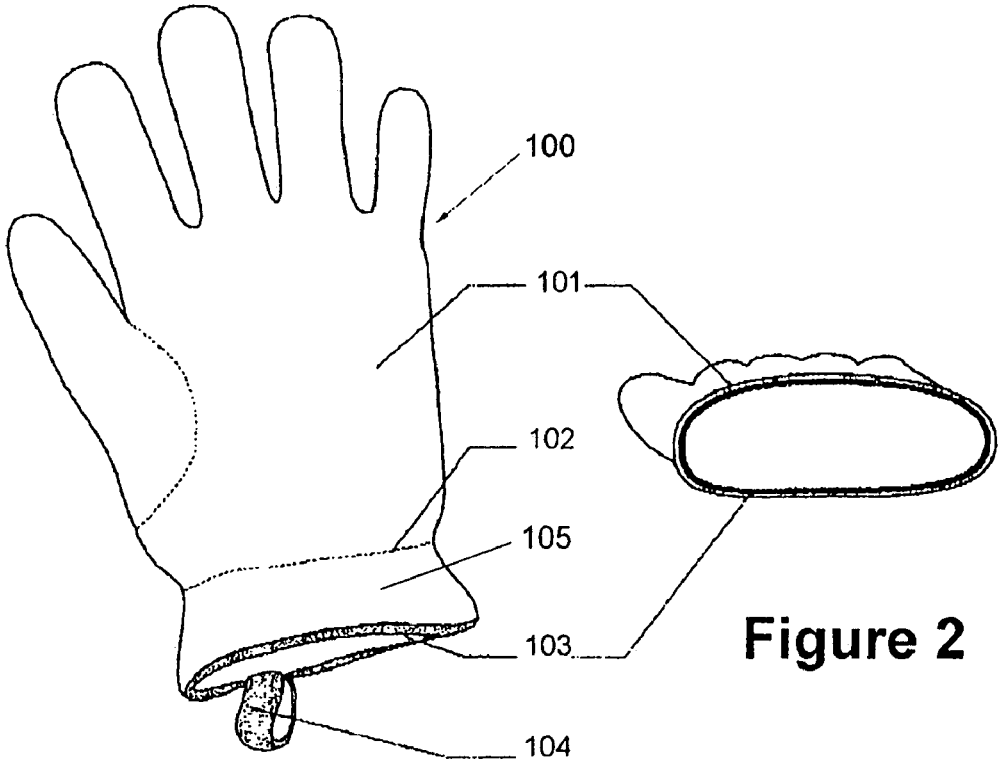
Figure 2
Figure 1
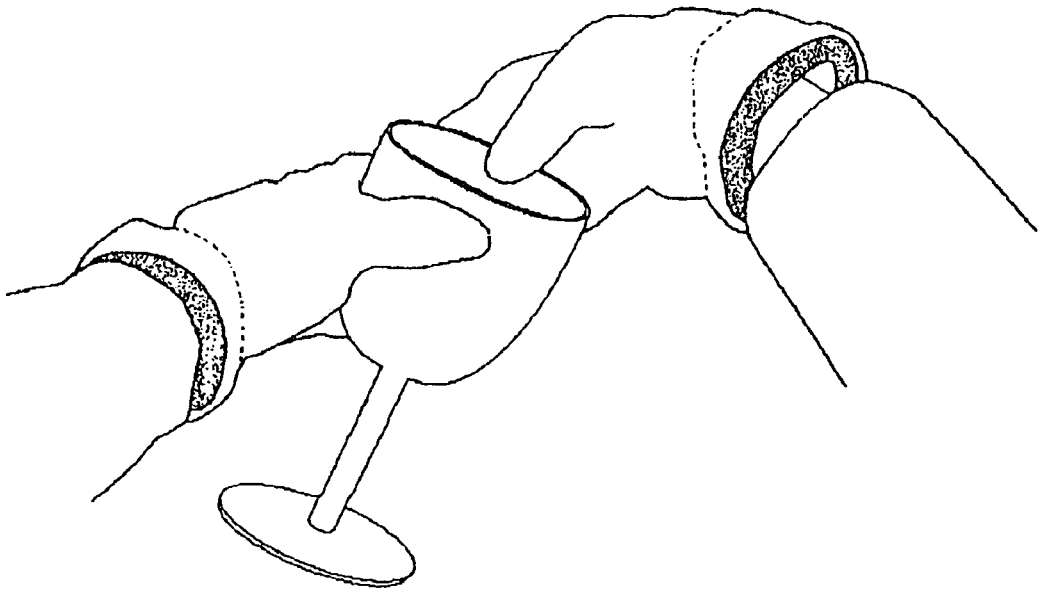
Figure 3

DRYING GLOVE

CLAIM OF BENEFIT

This application claims benefit of U.S. Provisional Patent Application 60/601,710, filed on 16 Aug. 2004, which is herein incorporated by reference.

FIELD OF THE INVENTION

The present invention relates to gloves that are used for specific utility. In particular, the present invention relates to gloves for the human hands, and more specifically to gloves for the human hands that are worn while handling an object for the purpose of drying or polishing it.

BACKGROUND OF THE INVENTION

People who need to dry a moist or wet object in the kitchen, home, garage, or elsewhere, or otherwise need to remove liquid from an object, generally use a piece of cloth made of cotton, paper towel, or other moisture absorbent material. The method of operation is usually dabbing or wiping the wet surface with the piece of cloth in order to absorb and remove moisture. During this operation, the wet object is handled either by bare hand or with the same piece of cloth used for drying, while it is being dried.

While this method may be partially effective for drying, holding the object with bare hand has the disadvantage of depositing fingerprints and smear marks on the object. Attempting to hold the object with the same cloth used for drying it, is difficult in that the same piece of fabric is employed in performing two entirely different tasks of holding securely and drying. Trying to hold the object with a second piece of cloth is awkward in that it is difficult to juggle the object and the two pieces of cloth. Therefore, there is a risk of dropping the object. Furthermore, using a piece of cloth poses an additional challenge in drying. Thorough drying of every crevice and contour of an object including surface recessions, grooves, channels, cuts, openings, internal parts, and other hard to reach areas is difficult with a regular towel or paper towel. As a result, one of the following undesirable effects may occur. The object is only partially dried, smear marks and fingerprints are deposited and left on the object, or the object is dropped and damaged.

Similarly, when people want to polish an object, for example silverware, they use a simple rag. While using a rag may be somewhat effective, it is usually unsafe, because the rag offers minimal protection from the polishing agent used. These polishing agents usually contain chemicals that are harmful to the skin of the user. All of the shortcomings of a piece of cloth for drying mentioned above also apply to using a rag for polishing. In addition, a polishing agent may cause great harm to the user's hand. Further, depositing fingerprints and smear marks on an object being polished, counteracts the purpose of the polishing job. Holding the object securely while working on its surfaces with a simple rag is not easy and presents the considerable risk of dropping and damaging the object.

On the other hand, in the field of devices worn on hands as hand covering, there have been many types of glove or glove-like inventions for a variety of purposes. Some of these gloves provide protection for the hands of the user while playing certain sports. Some other gloves provide protection from heat when the user needs to handle a hot object, such as picking up a hot pot in the kitchen. Yet, other gloves provide protection from cold temperature. For example, there are protective gloves used for handling ice or dry ice, and protective gloves used in winter. Yet some other gloves have been utilized for the purpose of washing objects. Although these devices may be suitable for the specific purposes which they address, they do not solve the problems in drying and polishing operations which were explained above. None of the devices explained in this section or present in prior art solves the problem of holding securely and drying an object.

Hence, there is a need in the art for a device that can be used to perform the dual tasks of securely holding a moist or wet object, and drying it to the desired degree. Furthermore, there is a need in the art for a device that can be used to perform the dual tasks of securely holding an object and polishing it. Such devices should prevent bare hand contact with the object in order to avoid smear marks.

SUMMARY OF THE INVENTION

Some embodiments of the invention provide a moisture absorbent hand-covering device that is in the form and shape of a glove for drying. In some embodiments, the drying glove of this invention has a first outer layer and a second inner layer. The outer layer comprises at least one layer of material with propensity to absorb at least one type of liquid. In some embodiments, the second inner layer comprises at least one layer of material with propensity to repel at least one type of liquid. The outer layer absorbs the liquid for the purpose of removing it. The inner layer resists passage of the liquid, and thus protects the hand of the user during operation. In some embodiments, the liquid absorbed is water, and the liquid repelled is water.

Some embodiments of the invention provide a hand-covering device that is in the form and shape of a glove for polishing. In some embodiments, the polishing glove has a first outer layer and a second inner layer. The outer layer comprises at least one layer of material that at least partially absorbs a polishing agent. The inner layer comprises at least one layer of material that at least partially repels a polishing agent. The outer layer at least partially absorbs the polishing agent for the purpose of applying it to the object being polished. The inner layer resists passage of the polishing agent, thus protecting the hand of the user during operation.

Some embodiments of the drying glove are produced in pairs, one for each hand of a user. Some embodiments receive and cover hands of a user from fingertips to at least wrist area. In some embodiments, the drying glove has a sleeve that starts from substantially below the wrist area and extends above it. Some embodiments provide a short sleeve that ends above the wrist area. Some other embodiments provide a longer sleeve that extends up the user's arms beyond the wrist area. Other embodiments may be constructed differently. For instance, some embodiments comprise only one layer. These embodiments do not provide the inner second layer. Some embodiments are made in one-size-fits-all configuration. Some other embodiments are made as fitted gloves configured according to predetermined hand sizes.

BRIEF DESCRIPTION OF THE DRAWINGS

The novel features of the invention are set forth in the appended claims. However, for purpose of explanation, several embodiments of the invention are set forth in the following figures.

FIG. 1 illustrates the left hand glove of some embodiment of the invention.

FIG. 2 illustrates the profile view of the right hand glove facing the aperture leading to the pocket for receiving hand of a user.

FIG. 3 illustrates an exemplary usage of the current invention, showing a user who has worn both gloves and is operating on a drinking vessel.

DETAILED DESCRIPTION OF THE INVENTION

Figure 4:
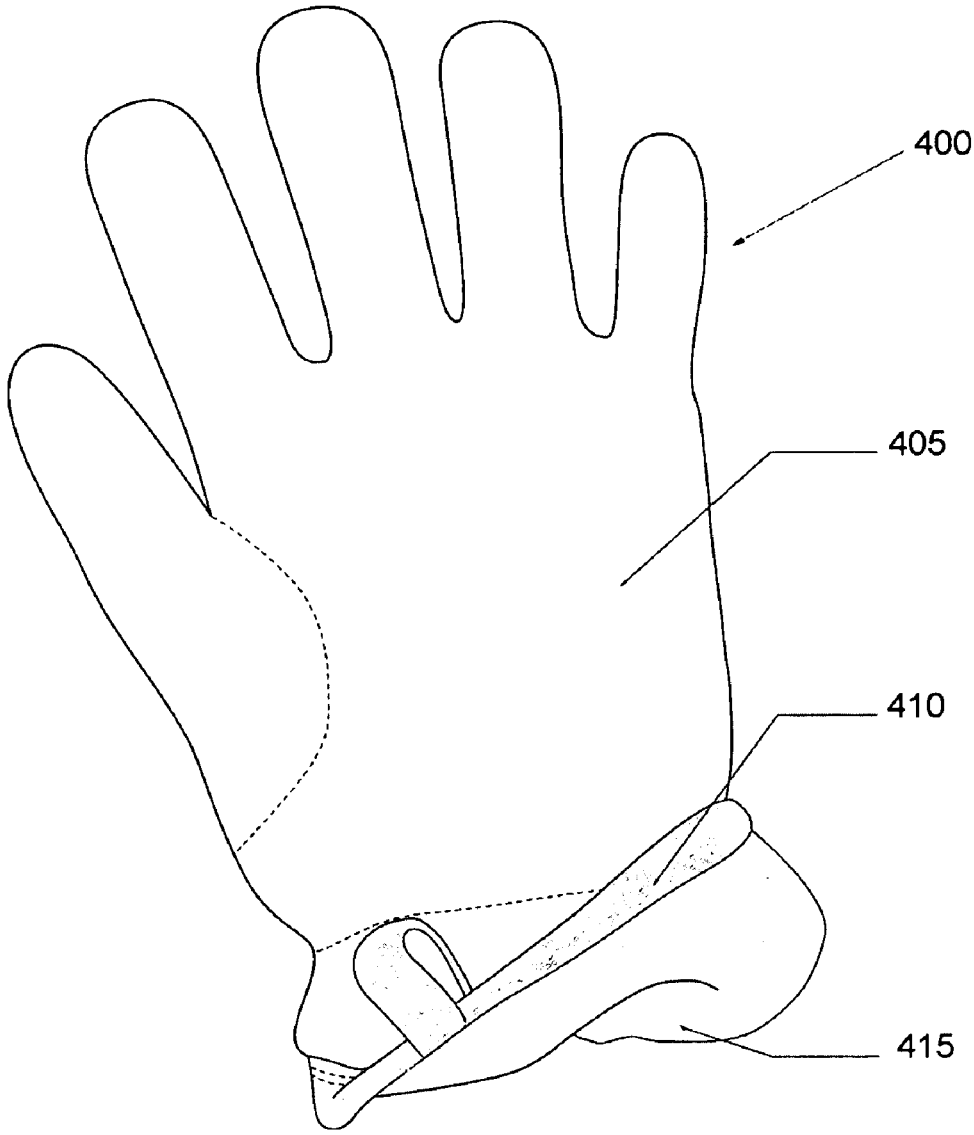
FIG. 4 illustrates some five-finger embodiment that has been partially turned inside out in order to show inner lining.

In the following detailed description of the invention, numerous details, examples and embodiments of the invention are set forth and described. However, it will be clear and apparent to one skilled in the art that the invention is not limited to the embodiments set forth and that the invention may be practiced without some of the specific details and examples discussed.

Some embodiments of the invention provide a moisture absorbent hand-covering device that is in the form and shape of a glove for drying. In some embodiments, the drying glove of this invention has a first outer layer and a second inner layer. The outer layer comprises at least one layer of material with propensity to absorb at least one type of liquid. In some embodiments, the second inner layer comprises at least one layer of material with propensity to repel at least one type of liquid. The outer layer absorbs the liquid for the purpose of removing it. The inner layer resists passage of the liquid, and thus protects the hand of the user during operation. In some embodiments, the liquid absorbed is water, and the liquid repelled is water.

Some embodiments of the invention provide a hand-covering device that is in the form and shape of a glove for polishing. In some embodiments, the polishing glove has a first outer layer and a second inner layer. The outer layer comprises at least one layer of material that at least partially absorbs a polishing agent. The inner layer comprises at least one layer of material that at least partially repels a polishing agent. The outer layer at least partially absorbs the polishing agent for the purpose of applying it to the object being polished. The inner layer resists passage of the polishing agent, thus protecting the hand of the user during operation.

Some embodiments of the drying glove are produced in pairs, one for each hand of a user. Some embodiments receive and cover hands of a user from fingertips to at least wrist area. In some embodiments, the drying glove has a sleeve that starts from substantially below the wrist area and extends above it. Some embodiments provide a short sleeve that ends above the wrist area. Some other embodiments provide a longer sleeve that extends up the user's arms beyond the wrist area. Other embodiments may be constructed differently. For instance, some embodiments comprise only one layer. These embodiments do not provide the inner second layer. Some embodiments are made in one-size-fits-all configuration. Some other embodiments are made as fitted gloves configured according to predetermined hand sizes.

Some embodiments are designed specifically for the purpose of drying kitchen dishes and other household items, such as windows, kitchen cabinets, and glassware. Some embodiments are designed specifically for the purpose of polishing objects, for example silverware. Some of the polishing embodiments have two layers. The outer layer partially absorbs a polishing agent for the purpose of applying it to the object, where the inner layer repels the polishing agent to protect the hand of the user. Some embodiments are used to dry or clean automobile windows, windshields, industrial items, etc. Drying glove is a convenient tool for handling and drying objects of any kind with added security against dropping the object, and with reduced risk of depositing unwanted fingerprints and smear marks. Further, the drying glove is suitable for dusting objects of any kind.

Some embodiments provide an inner layer comprising of a moisture-resistant or moisture-repellent material for protection of user's hands from moisture and wetness of the object being dried. During operation of this invention, drying is done with ease, while the object is securely held, and the user's hands are protected from the wetness, be it from water or other liquid. The inner layer in some embodiments is especially treated to repel a specific liquid, for example water, thus protecting the hands of the user from that liquid. Some embodiments include two layers, which target a specific liquid to be absorbed by the outer layer, while being repelled, inhibited, or rejected by the inner layer. This targeting is done in several ways, for example, specialized fabric, specialized treating of fabric, etc.

Some embodiments are made from at least one layer of disposable moisture-absorbent material, such as absorbent paper (i.e., paper towel). These embodiments teach a new disposable device for dexterous and easy liquid removal. Similar to non-disposable embodiments, disposable embodiments of this invention have various forms (e.g., five-finger gloves, six-finger gloves, mittens, etc).

Several embodiments are described herein for drying dishes or other articles, or for removing any type of liquid from objects or surfaces. One of ordinary skill in the art will realize that other embodiments of the invention may be used for other purposes.

I. Configuration

Some embodiments provide a device for covering a human hand where the glove has at least one sheath for receiving a user's hand or fingers. Some embodiments comprise at lease one layer made of some material or fabric suitable for special purposes of those embodiments.

FIG. 1 and FIG. 2 illustrate a drying glove of some embodiments of the invention. FIG. 1 presents the vertical view from the palmar side, and FIG. 2 presents the perspective view facing the hand entry aperture of the glove. As shown in these figures, the glove 100 is produced in the shape of a five-finger glove. In other words, the glove 100 has hand coverings with a separate sheath for four fingers and one thumb. The glove 100 has two layers. The outer layer 101 is moisture absorbent. The inner layer, which covers inside of the outer layer and is not visible in these two figures, is moisture repellent. An elastic band 102 has been affixed to about the beginning of glove 100's sleeve 105 area to enable a snug fit. A trim 103 has been sewn around the edges of the hand entry aperture to bind the layers together and provide more robustness. A loop 104 has been sewn to edge of the aperture, and is used to hang the glove 100 when not in use.

FIG. 4 illustrates a glove 400 of some embodiment. The glove 400 is similar to glove 100, but with the sleeve turned partially inside out in order to illustrate the inner layer 415. This figure presents two layers. The outer layer 405 is similar to the outer layer 101 of FIG. 1. The inner layer 415 is presented in FIG. 4, but is not visible in FIG. 1. Trim 410 is similar to trim 103 of FIG. 1.

Figure 5:
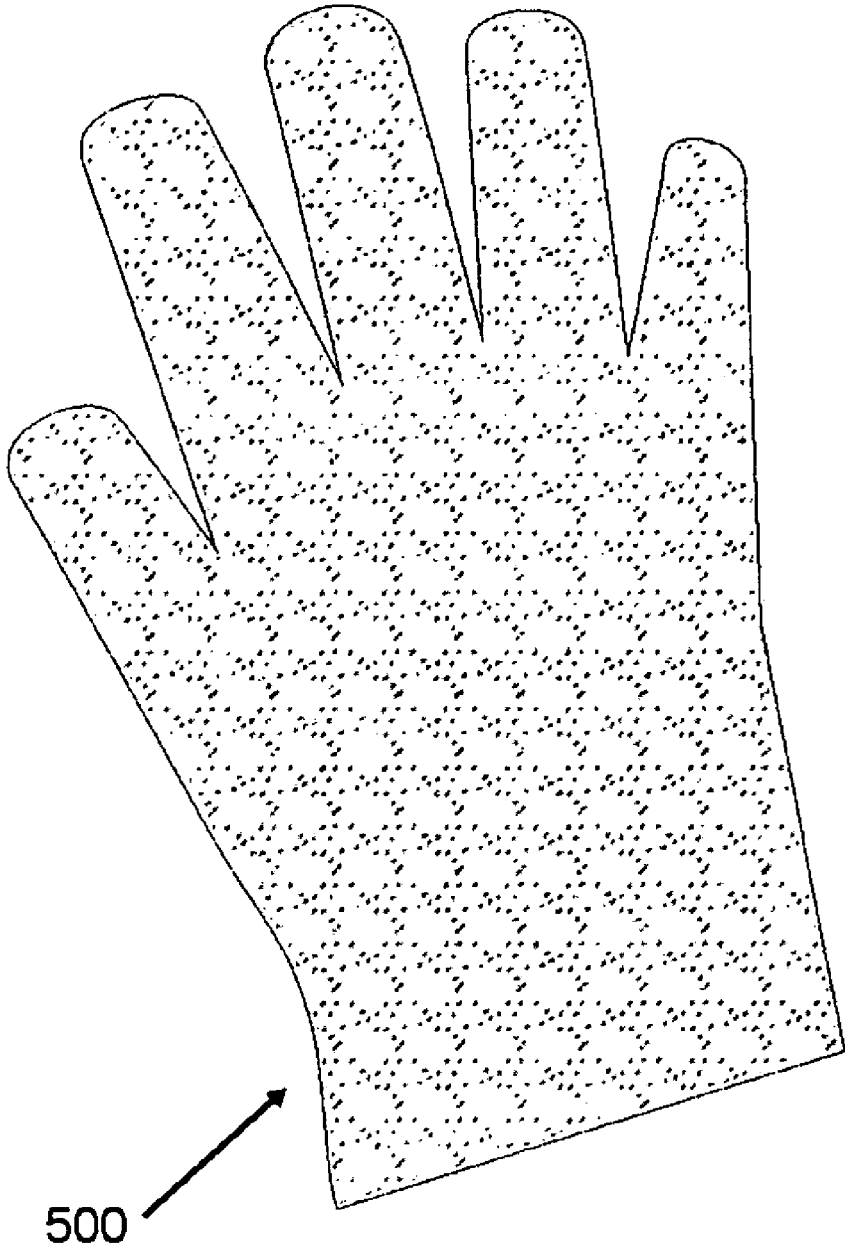
FIG. 5 illustrates some disposable embodiment made from paper towel.
Figure 6:
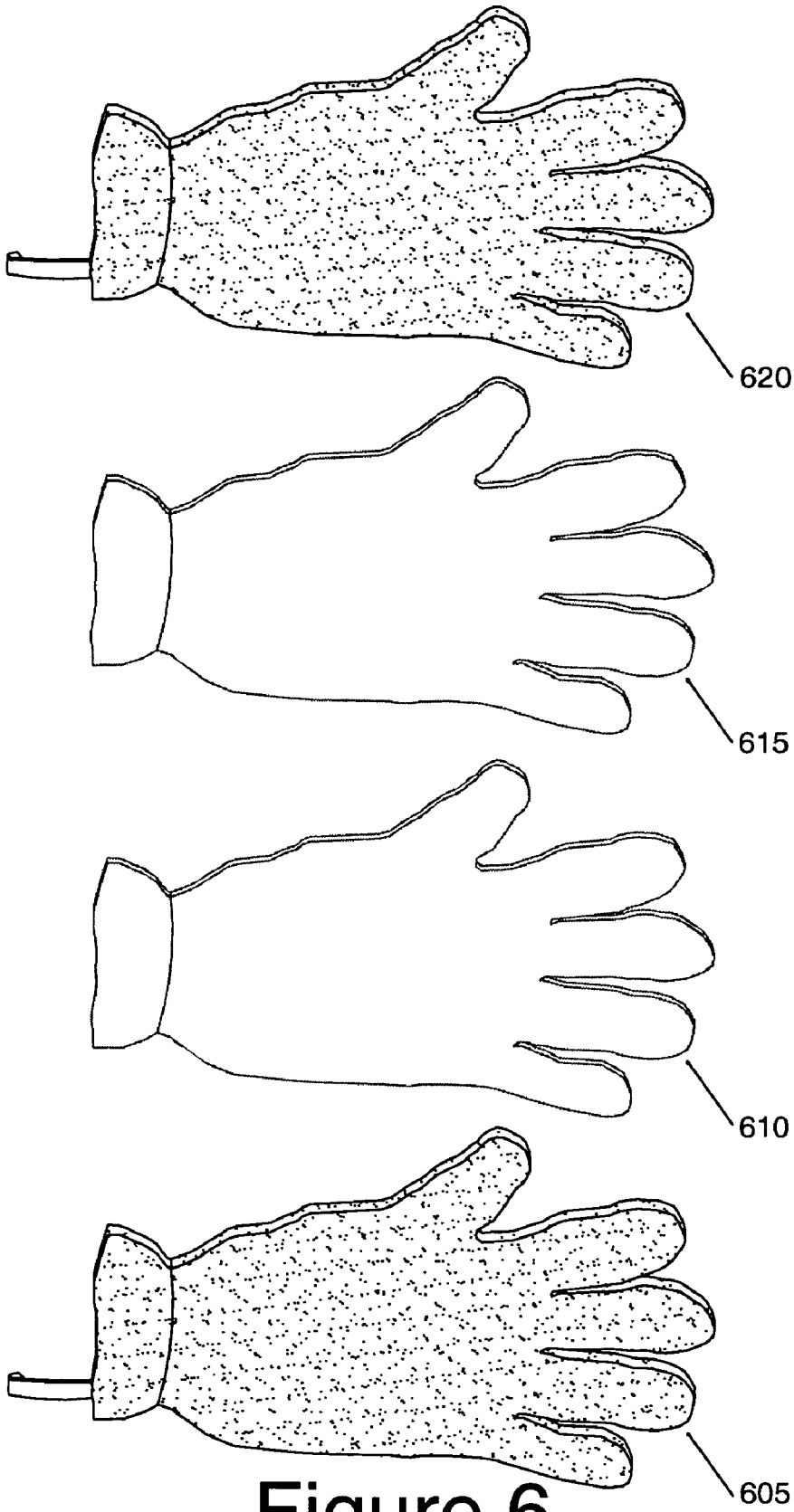
FIG. 6 illustrates four cuts of fabric that are produced in one of methods of production of some embodiments described herein.

Some embodiments are configured in the shape of a five-finger glove that is similar to the glove 100 of FIG. 1, but has the thumb sheath placed in a neutral middle position with respect to dorsal and palmar surfaces. In these embodiments, the dorsal and palmar sides become indistinguishable. Therefore, each hand covering can be worn on either right or left hand. Each surface of glove can serve as either palmar or dorsal surface depending on which hand is placed in it. Glove 500 of FIG. 5 and a glove whose exploded layers are presented in FIG. 6, illustrate some embodiments of this configuration.

Figure 7:
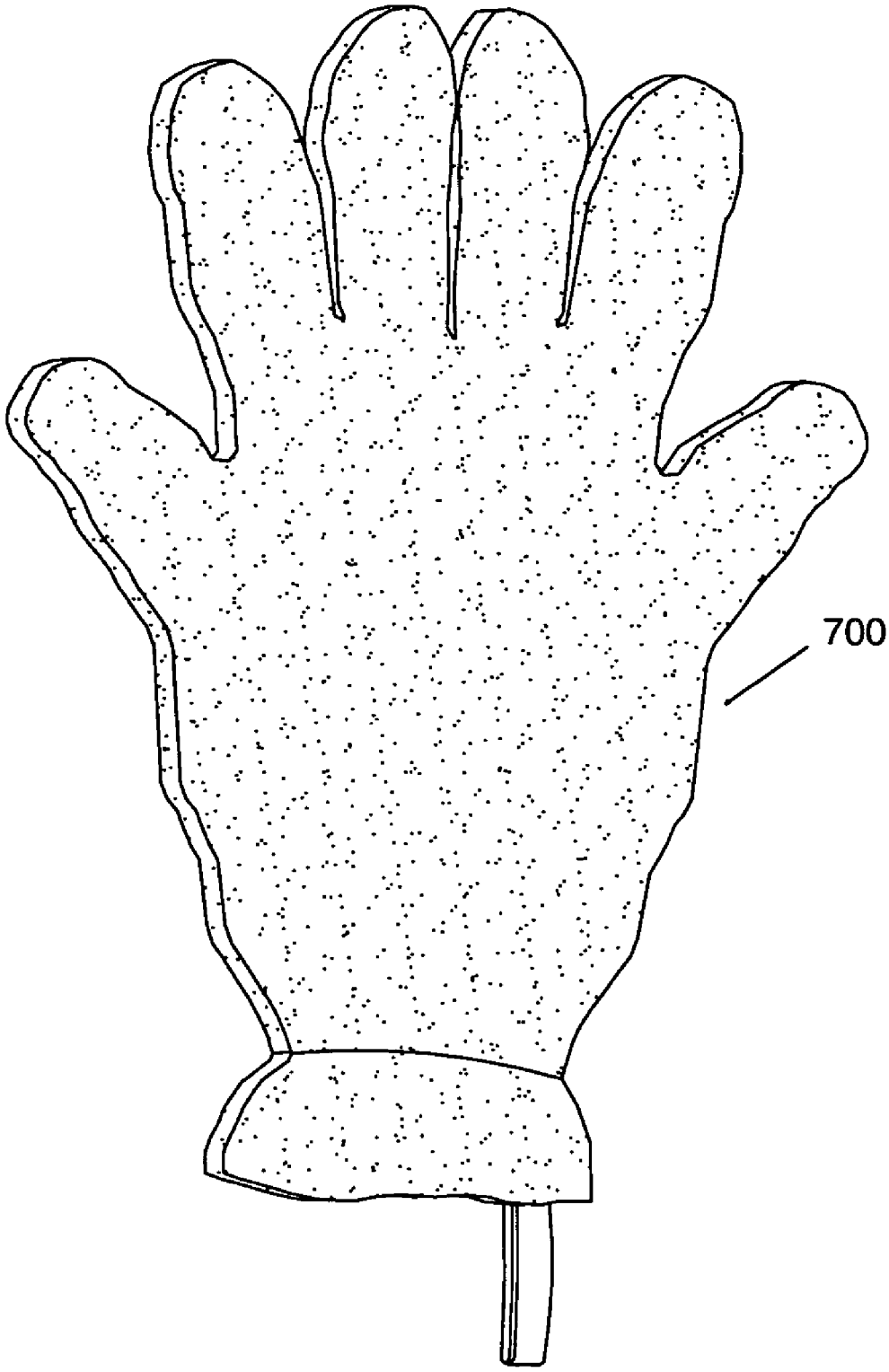
FIG. 7 illustrates some six-finger embodiment of the current invention.

FIG. 7 illustrates a glove 700 of some embodiment of the invention. The glove 700 is configured in the shape of a six-finger glove. That is hand covering with a separate sheath for each finger, and two separate sheaths for thumb on either side of the hand covering. In this embodiment, each hand covering can be worn on either left hand or right hand, utilizing one or the other thumb sheath.

Figure 8:
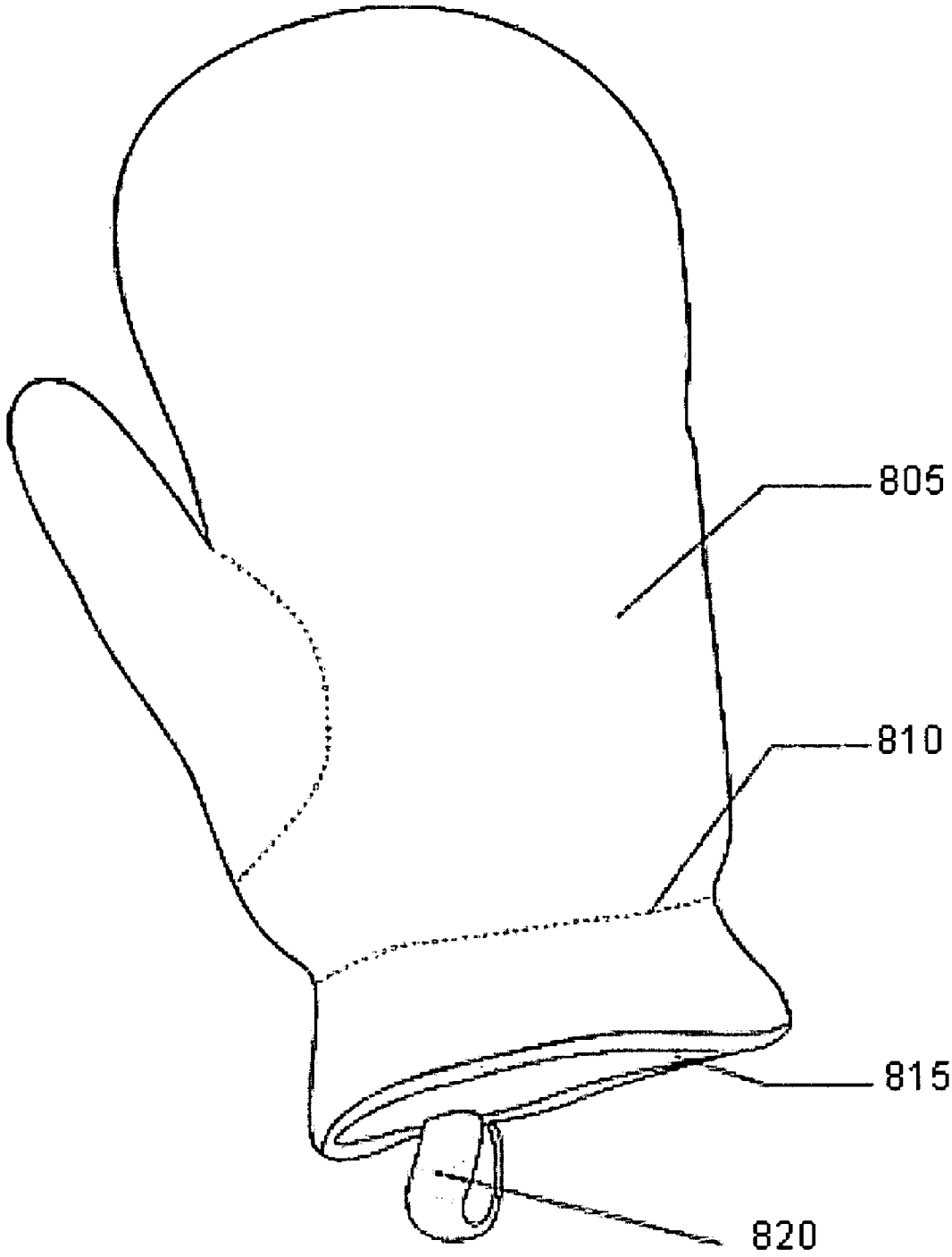
FIG. 8 illustrates some mitten embodiment of the current invention.

Still other embodiments are produced in the shape of hand covering which encase the thumb separately and the other four fingers together, thus producing a drying mitten. FIG. 8 illustrates such a mitten embodiment of the drying glove. This embodiment has two layers, an outer layer 805 and an inner layer 815. The illustrated embodiment has an elastic band 810 around the wrist area to tighten the fit around the wrist area of the user. It also has a loop 820 so that the drying mitten can be hung when not in use. In this embodiment, thumb sheath has been placed further into the palmar surface in order to make the device more comfortable to wear and operate. In some other embodiments, thumb sheath is placed in mid-position relative to palmar and dorsal surfaces, thus rendering palmar and dorsal surface of each mitten indistinguishable. The latter embodiments can be worn on either hand.

As mentioned earlier, some embodiments are configured to fit any hand. In other words, these embodiments are designated one-size-fits-all, and thus can be used by any user with any hand size. These embodiments are not fitted hand coverings. Other embodiments are configured as fitted covering for a hand. These embodiments are designed to predetermined glove sizes.

Some embodiments are made in one layer configuration. Some embodiments are made in configurations of several layers. For example, some embodiments are made in a three-layer configuration where the outer layer is of moisture absorbent material, the middle layer is of moisture resistant nature, and the inner layer is of a material comfortable for skin to touch. Other embodiments may have configurations where each layer has a different nature and purpose than stated herein.

II. Material

As mentioned above, some embodiments of the current invention illustrated in FIG. 1, FIG. 2, FIG. 3, FIG. 4, and FIG. 8 illustrate some embodiments that are made of two layers, an outer layer and an inner layer. The material used for either of the two layers can be of any variety of natural or synthetic fabrics, or a combination thereof.

A. Outer Layer

In some embodiments, the outer layer is formed from a material with propensity to absorb moisture. This moisture absorbent material can be any type of natural or synthetic fabric or material that has capacity to absorb liquid. For example, material for the outer layer may comprise cotton or terrycloth or absorbent paper (i.e., paper towel) or any other wood pulp based material or any pile fabric or micro-fiber or waffle-weave or velvet or other natural fabric or other synthetic material or material to be invented or discovered in the future, or a combination thereof. Some embodiments use heavy terrycloth for the outer layer. Some embodiments use absorbent paper (i.e., paper towel) for the outer layer. Main raw material for production of this invention's outer layer is selected based on that material's propensity to absorb moisture and liquid. The main feature sought in the outer layer material is moisture absorbency.

In some embodiments, the outer layer is formed from a material that at least partially absorbs a polishing agent. This material can be any type of natural or synthetic fabric or material. These embodiments comprise any of the material mentioned in this section, or a specifically designed material, or a specially treated material, or a combination thereof.

Some embodiments are made from absorbent paper (i.e., paper towel). For example, one such embodiment is illustrated in FIG. 5. The material for these embodiments comprises absorbent paper (i.e., paper towel), heavy industrial moisture absorbent paper, or other wood pulp based material.

In some other embodiments, the dorsal and palmar portions of the outer layer are made from different types of material. In other words, the palm portion covering the palm of the user is made of a different material than the back portion covering the back of the hand of the user. One of these different types of material, for example the material for the palmar portion, is moisture absorbent and the other is abrasive. These embodiments enable the user to perform drying, polishing, and scrubbing of an object.

B. Inner Layer

In some embodiments, the inner layer is formed from a material with propensity to inhibit moisture. This moisture repellent material can be any natural or synthetic fabric or material that has the capacity to repel, resist, inhibit, insulate from, or reject liquid. Some embodiments use waterproofing-treated polyester for the inner layer. Main raw material for production of the inner layer is selected based on that material's propensity to resist or repel liquid or moisture. For example, material for the inner layer may comprise rubber, nylon, any type of plastic, waterproofing treated polyester, vinyl, acrylic, rayon, other types of polyester, any other natural or synthetic material available now or to be invented or discovered in the future, or a combination thereof.

In some embodiments, the inner layer is formed from a material that resists at least one type of polishing agent. This polishing agent repellent material can be any natural or synthetic fiber or material that has the capacity to repel, resist, inhibit, insulate from, or reject at least one type of polishing agent. This material can be any type of natural or synthetic fabric or material. The material for the inner layer of these embodiments may comprise any of the material mentioned in this section, or a specifically designed material, or a specially treated material, or a combination thereof.

FIG. 1, FIG. 2, FIG. 3, FIG. 4, and FIG. 8 illustrate some two-layer embodiments of the invention. A moisture-absorbent or moisture-retentive material, as explained earlier, is used as the primary raw material for production of the outer layer 101. In some embodiments, a non-porous, moisture-resistant, moisture-repellent, or moisture-insulating material, as explained earlier is used for the inner layer 415. In some embodiments, an elastic band 102 is added substantially about the wrist area in order to tighten the fit around the wrist of the user and allow a larger aperture entry. The material for the elastic band is selected based on its elasticity. The material for the optional elastic band may comprise any of the raw materials explained above. Further, a trim 103 can optionally be included for added protection of edges, and for aesthetic appeal. A loop 104 can also be optionally added to the inner layer, the outer layer, or the trim. The loop can be used for hanging the device when not in use. The material for the trim and the loop comprises the inner layer material, the outer layer material, or other suitable material.

III. Method of Operation

Some embodiments are used for drying dishes or other articles. Further, this invention can be used for polishing dishes or other articles, performing auto detailing, or other personal or professional usage. In some embodiments, a user employs this invention for removing any liquid that may have accumulated in, on, or about any object or surface. The wetness or moisture that is targeted to be reduced or eliminated by some embodiments of this invention does not have to be water-based. Any wetness of an object or surface is reduced or substantially eliminated by usage of some embodiments of the current invention.

Some embodiments of the drying glove can be worn on one or both hands, providing flexibility, ease, security, and comfort for the task of drying. In addition, some embodiments can be used for polishing dishes or other articles, or for performing auto detailing. One method of drying operations of some embodiments is a fusion of usage of gloves in conjunction with usage of towels.

Figure 9:
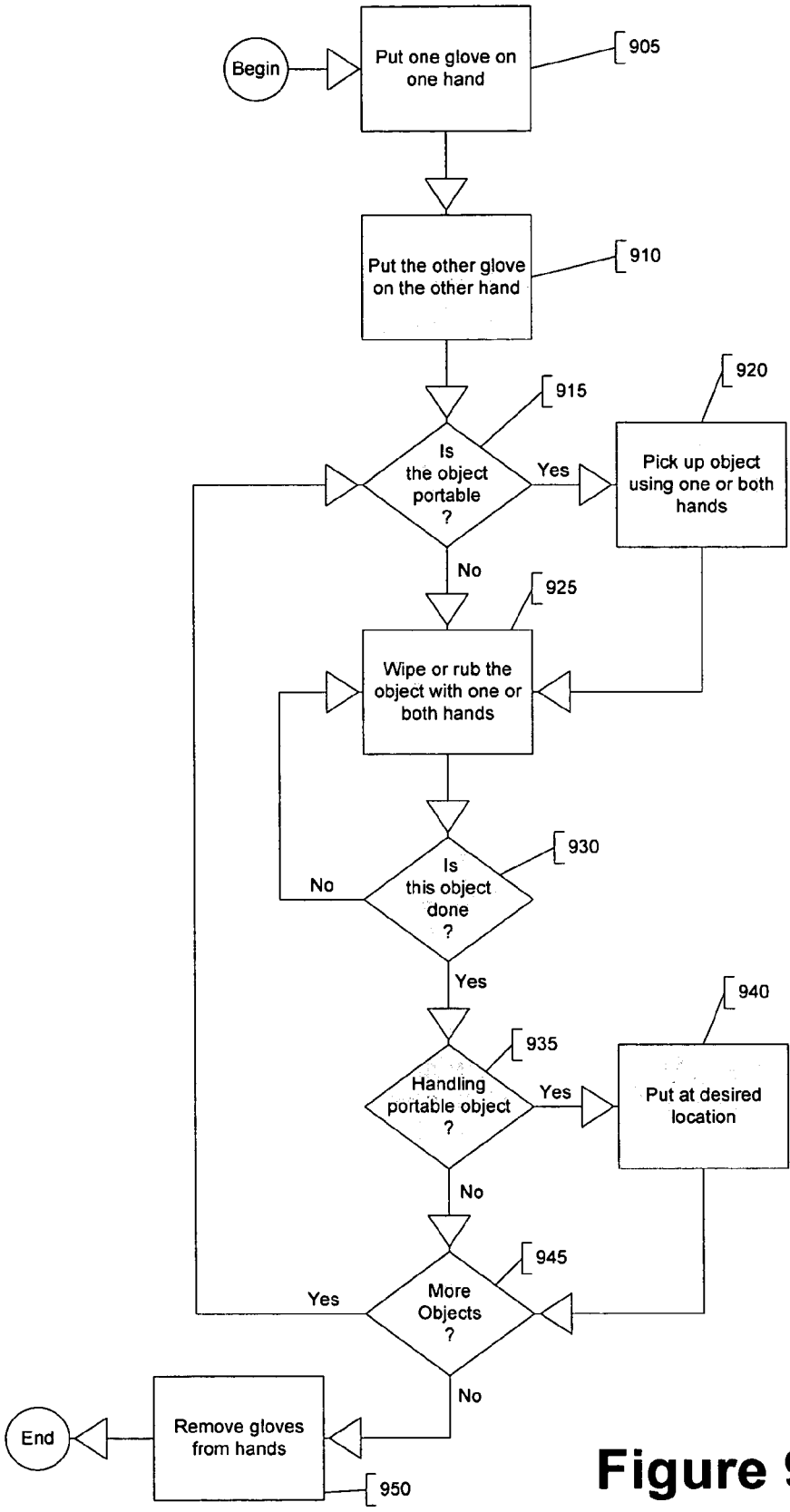
FIG. 9 illustrates a flowchart of some embodiment's method of operation.

FIG. 9 presents the flow of steps taken in normal operations of some embodiments, where a user wants to dry or polish an object. Operation begins with step 905 where the user puts one glove on one hand. It continues with step 910 where the user puts the other glove on the other hand. At the next step 915, the user determines whether the object is portable and should be picked up. If the user decides to pick up the object, he/she proceeds to pick it with one or both hands at step 920. This step is skipped should the user decides not to pick up the object.

The user then proceeds at step 925 to wipe or rub outer surface of one or both gloves onto surfaces of the object. At the next step 930, the user decides whether the object has been sufficiently dried or polished. If the user decides that the object is not sufficiently done, he/she repeats step 925 until the object is done to the user's satisfaction. At the next step 935, if the user is handling a portable object, he/she puts the object at a desired location 940. At the next step 945, user decides whether there are other objects to be processed. If the user decides to continue, he/she goes back to step 915 above, and repeats the steps that follow it.

When the user decides to stop operating this invention, he/she removes the gloves at step 950 that ends the operations. During the above operation of some embodiments of this invention, the user holds the target object securely with one or both hands. Furthermore, the user has usage of all ten fingers to reach substantially every corner and crevice of the target object.

IV. Method of Manufacture

In some embodiments, the glove is made from one layer of moisture absorbent material. In some embodiment, such as those presented in FIG. 1 and FIG. 2, the glove is produced in two layers. The outer layer is produced from moisture absorbent material, and the inner layer is produced from moisture resistant material.

Figure 10:
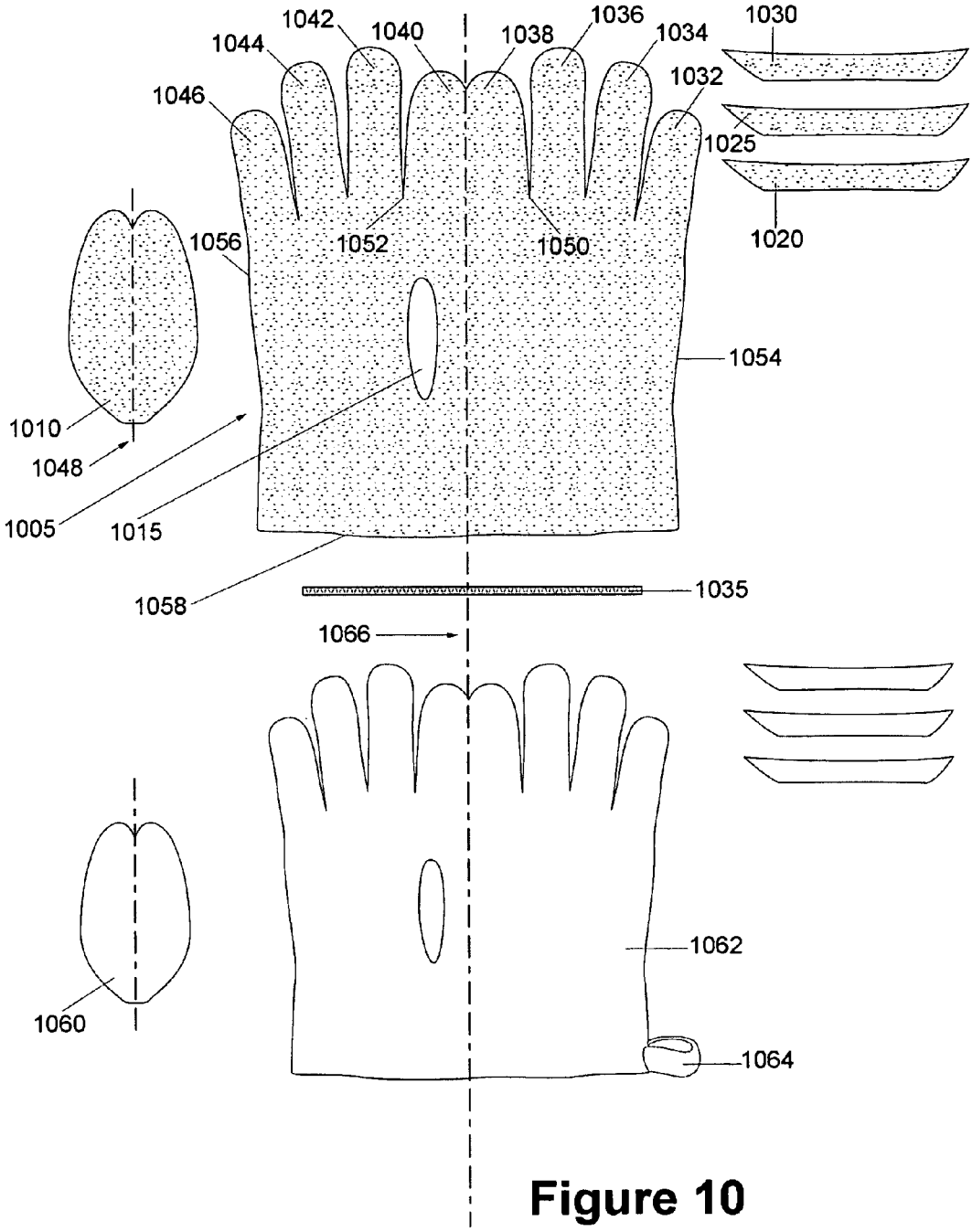
FIG. 10 illustrates cuts of fabric used to produce some embodiments of the current invention.

FIG. 10 illustrates cuts of fabric that are made in process of manufacturing some embodiments. A material is chosen for the outer layer as explained in the "Material" section. That material is then cut in shapes 1005, 1010, 1020, 1025, and 1030. The main portion 1005 has a hole 1015 cut out of it. Later in the process, a thumb sheath is made from cut 1010 and attached to portion 1005 at edges of the hole 1015. Top sections of cut 1005 form sheaths for the fingers. To make the main body of the outer layer, cut 1005 is folded along an imaginary vertical line 1066 in its middle. Once folded, section 1038 is aligned with section 1040 in preparation for making a sheath for index finger. Similarly, section 1036 is aligned with portion 1042 in preparation for making a sheath for middle finger. Portion 1034 is aligned with portion 1044 in preparation for making a sheath for ring finger. Portion 1032 is aligned with portion 1046 in preparation for making a sheath for little finger.

Figure 11:
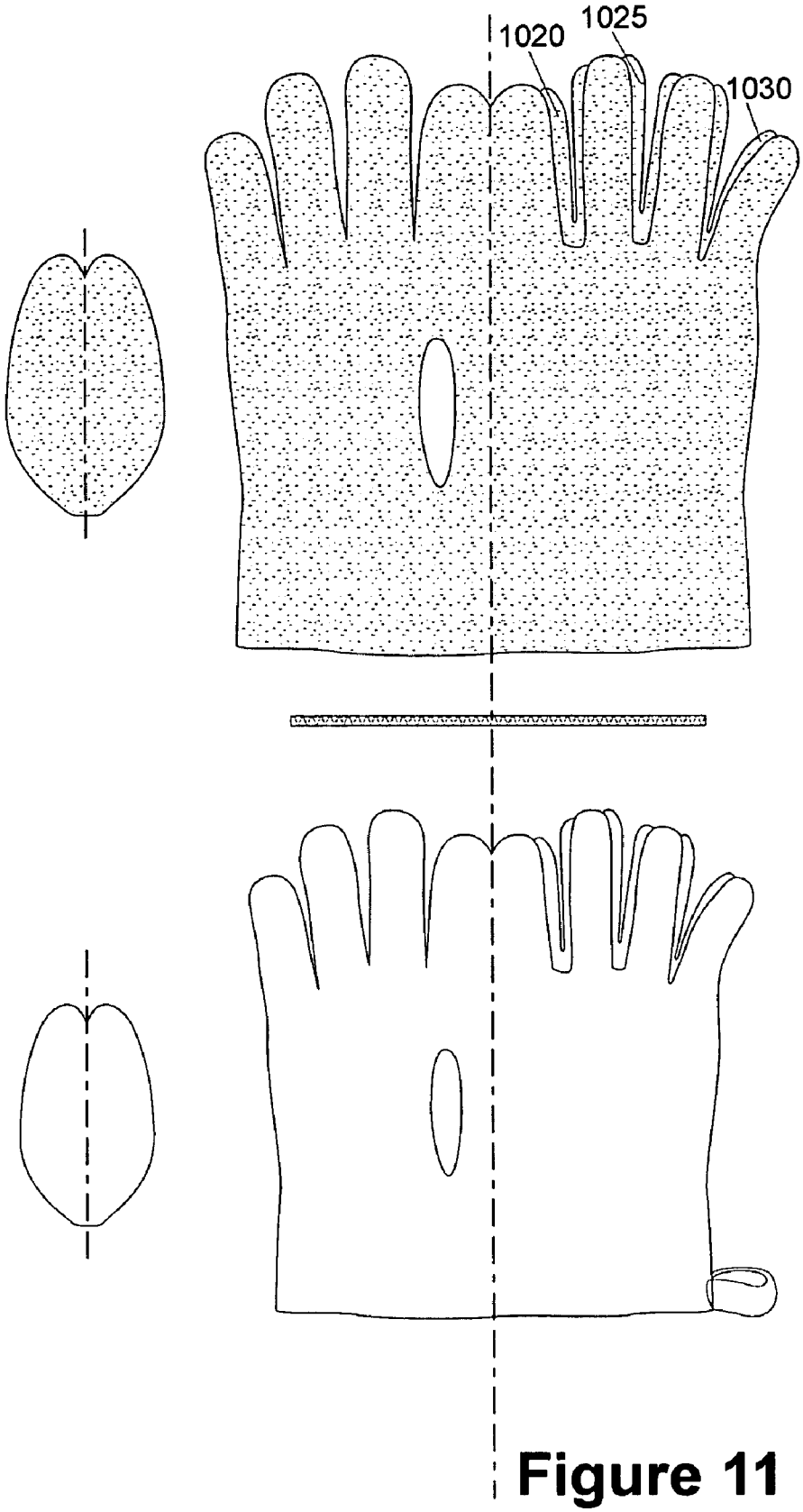
FIG. 11 illustrates same cuts as FIG. 10, but with interdigital pieces partially sewn in, so as to clarify their positioning.

Cuts 1020, 1025, and 1030 provide extra fabric for interdigital spaces between finger sheaths. These cuts are sewn in along edges between portions for finger sheaths in order to provide more fabric for interdigital space. First, these cuts are folded in half, and then they are inserted in the interstice between sections designated for finger sheaths. Finally, they are sewn to edges of those sections. FIG. 11 presents a partially sewn view of FIG. 10. Cuts 1020, 1025, and 1030 are referenced by the same numbers in FIG. 11. In FIG. 11, one length of cuts 1020, 1025, and 1030 edges have been sewn, and the other edges are not yet sewn. When completed, the extra fabric provided in this manner allows finger sheaths to better conform to the shape of fingers, and thus be more comfortable for the user. For instance, cut 1020 covers the interdigital space between index finger and middle finger. The edges of portion 1020 are sewn to the edges of adjacent portions 1038, and 1036. They are also sewn to the edges of 1040, and 1042 which are counterparts of 1038, and 1036. In other words, each end point of piece 1020 is aligned with, and sewn to, one of points 1050 and 1052. As a result extra fabric is provided for interdigital space between index and middle fingers. The extra fabric allows the finger sheaths to be more spacious and thus relaxes the fit in the interstice between index and middle fingers.

Similarly the cut 1025 covers the interdigital space between middle finger and ring finger. The edges of 1025 are sewn to edges of portions 1036, 1034, 1042, and 1044 in a manner substantially similar to cut 1020. This provides extra fabric thus relaxing the fit for interdigital space between ring and middle fingers. In a similar manner, cut 1030 is sewn along edges between portions 1032, 1034, 1044, and 1046 thus relaxing the fit between ring finger and little finger. The outer most edges of 1050, that is edges 1054 and 1056, are aligned and sewn together to complete the hand covering. The lower edge of 1005, namely edge 1058 is not sewn and thus provides an entry for receiving a hand.

Cut 1010 makes a thumb sheath. It is folded along the imaginary vertical line 1048. Cut 1010 is then sewn together around its edges to an extent sufficient to provide a thumb sheath. Lower edges of cut 1010 are sewn to around edges of hole 1015. Elastic band 1035 is sewn around the wrist portion of the resulting device to enable a tighter fit. The lower half of FIG. 10 shows cuts similar to those explained above. These cuts are somewhat smaller in size than cuts shown in top portion of FIG. 10. They are made from the fabric of choice for the inner lining. Cut 1062 forms the main body of the inner layer. Cut 1060 forms the thumb sheath of the inner layer. There are also three interdigital cuts corresponding to their outer layer counterparts. Process of sewing the pieces for the inner lining is substantially similar to that explained for the outer layer. Once both layers are ready, the inner lining is inserted into outer layer and is sewn along the edges. Alternatively, the inner lining cuts are matched to outer layer cuts from the beginning of the process and sewn together along all edges at the same time. In this embodiment, a loop 1064 is sewn to the inner layer material. Alternatively, the loop can be sewn to the outer layer, or both the inner layer and the outer layer. The loop is used to hang the drying glove when not in use.

The present invention can be made of different types of material as explained in "Material" section of this document. Each device may be made of only one layer of fabric, or more than one layer of fabric where each layer of fabric satisfies a different purpose, or performs a different task. Some embodiments of the present invention, such as the one presented in FIG. 10, have an inner layer to insulate the hands of the user from moisture and/or other external substances that may seep through the outer layer.

Some embodiments of the present invention are built as follows. The fabric of choice for the outer layer is cut in the form of a human hand. This cut is done a total of four times, thus producing two pairs of cuts, all in the shape of a hand. Then, the fabric of choice for the inner layer is cut similarly to above, but smaller. This produces two pairs of cuts from the inner layer material in the shape of a hand. FIG. 6 illustrates one of the pairs for the outer layer, and one of the pairs for the inner layer. Cuts 605 and 620 are made from the outer layer material. Cuts 610 and 615 are made from the inner layer material. As FIG. 6 illustrates, the aforementioned cuts have sections that form the finger sheaths. All cutting referenced in methods of manufacture can be done in a variety of ways using scissors, blades, machinery, or other means.

After the cuts are made, each corresponding pair is adhered together at around their edges. Cuts 605 and 620 are adhered together to form the outer layer. Cuts 610 and 615 are adhered together to form the inner layer. The wrist side edges of corresponding cuts are not adhered together, thus providing an aperture for entry of a hand. The inner layer is inserted into the outer layer such that each finger sheath of the inner layer enters and is substantially coextensive inside the corresponding finger sheath of the outer layer. The outer layer and inner layer are then adhered together. Cuts 605 and 620 present extra pieces of fabric that have been sewn into the wrist end of each cut. These pieces are sewn together to create a loop. In some embodiments, creation of the loop is optional. In some embodiments, the two layers of edges of hand-entry aperture just created are sewn together in order to secure the inner layer to the outer layer. In some embodiments, a trim is sewn to around the hand-entry aperture to further secure it.

In some embodiments, the adhering and affixing mentioned in methods of manufacture are done by means of one or more of the following: sewing, stitching, stapling, gluing, hot pressing, or other suitable method. FIG. 6 presents cuts that make one glove. Attaching the other two pairs of cuts produced above creates a second glove. Then, two devices with pockets for receiving a pair of human hands are created. In some embodiments produced in this manner, the thumb sheath is reversible, thus each glove can be worn on either a right hand or a left hand.

When several layers of fabric are used, layers are attached together in different manners. The attaching of layers can be done solely at the edge of the aperture, or layers of fabric can be attached together along finger sheaths as well. Yet in other embodiments, these layers of fabric are attached both at the edge of the aperture, and along seams where feasible and practicable. In embodiments where more than one layer of moisture-absorbent material is used, all layers may be adhered together along all seams. Alternatively, these layers may be adhered only at some points along their surfaces or seams sufficient to keep them together. In some embodiments of this invention as illustrated in FIG. 1, a trim 103 is adhered to around the edge of the aperture of the device in order to protect the edge by adding robustness and reducing wear and tear, as well as add aesthetic appeal. Some embodiments have a loop 104 attached to each glove to facilitate hanging when the device is not in use.

Some embodiments employ ergonomic design principles to arrange each finger sheath in a more comfortable position. For example, thumb sheath can be cut and sewn further into the palmar portion thus providing a more comfortable fit and grip for user as explained in FIG. 10 earlier. Yet some other embodiments position the thumb sheath such that it is reversible, (i.e., make glove wearable on either a right hand or a left hand as explained previously). Some of these embodiments with reversible thumb sheath are illustrated in FIG. 5 and FIG. 6. Alternatively, a finer production methodology of any kind known to a person skilled in the art of glove making can be utilized.

Some embodiments are produced without seams. That is, the outer layer is produced in one piece of material as part of a manufacturing process. Similarly, the inner layer is produced in one piece of selected material as part of a similar manufacturing process. The inner layer is then inserted into the outer layer and adhered to it at one or more locations. Other embodiments are produced by cutting material selected for the outer layer from a flat sheet of material according to a selected glove configuration and design. This is followed by cutting material selected for the inner layer from a flat sheet of material according to same or similar glove design as the outer layer. Then select edges of the inner layer are cohered together to produce pockets for receiving hand. The next step is to insert the inner layer inside the outer layer and fasten them together by adhering in select locations. In some embodiments finger sheaths are produced separately from the rest of the device. Then, the finger sheaths are attached to the hand covering in a second step.

In some embodiments, such as those illustrated in FIG. 1 and FIG. 10, the inner layer is manufactured to be somewhat smaller than the outer layer so that it fits inside the outer layer with ease. Further, these embodiments have an inner layer with a snugger fit. In addition, some embodiments provide a larger outer layer with more fabric to enable absorption of more liquid.

In some embodiments, the inner layer is longer than the outer layer. Therefore, in these embodiments, the inner layer extends above and beyond wrist area to protect more of user's arm. In yet other embodiments, the inner layer extends above and beyond the elbow area of the user. In some other embodiments, the outer layer is longer than the inner layer. In these embodiments, the inner layer ends at about the wrist area, whereas the outer layer extends beyond wrist area to about elbow area of user's arm. In other embodiments, the outer layer extends above and beyond elbow area. These embodiments provide a large outer surface for the job.

Conversely, in some embodiments, the inner layer is longer than the outer layer. In these embodiments, the outer layer ends at about the wrist area, whereas the inner layer extends beyond the wrist area of the user to about the elbow area. In some embodiments, the inner layer extends above and beyond the elbow area of the user. These embodiments provide a larger inner layer for expanded protection of the user's hand and arm.

Figure 12:
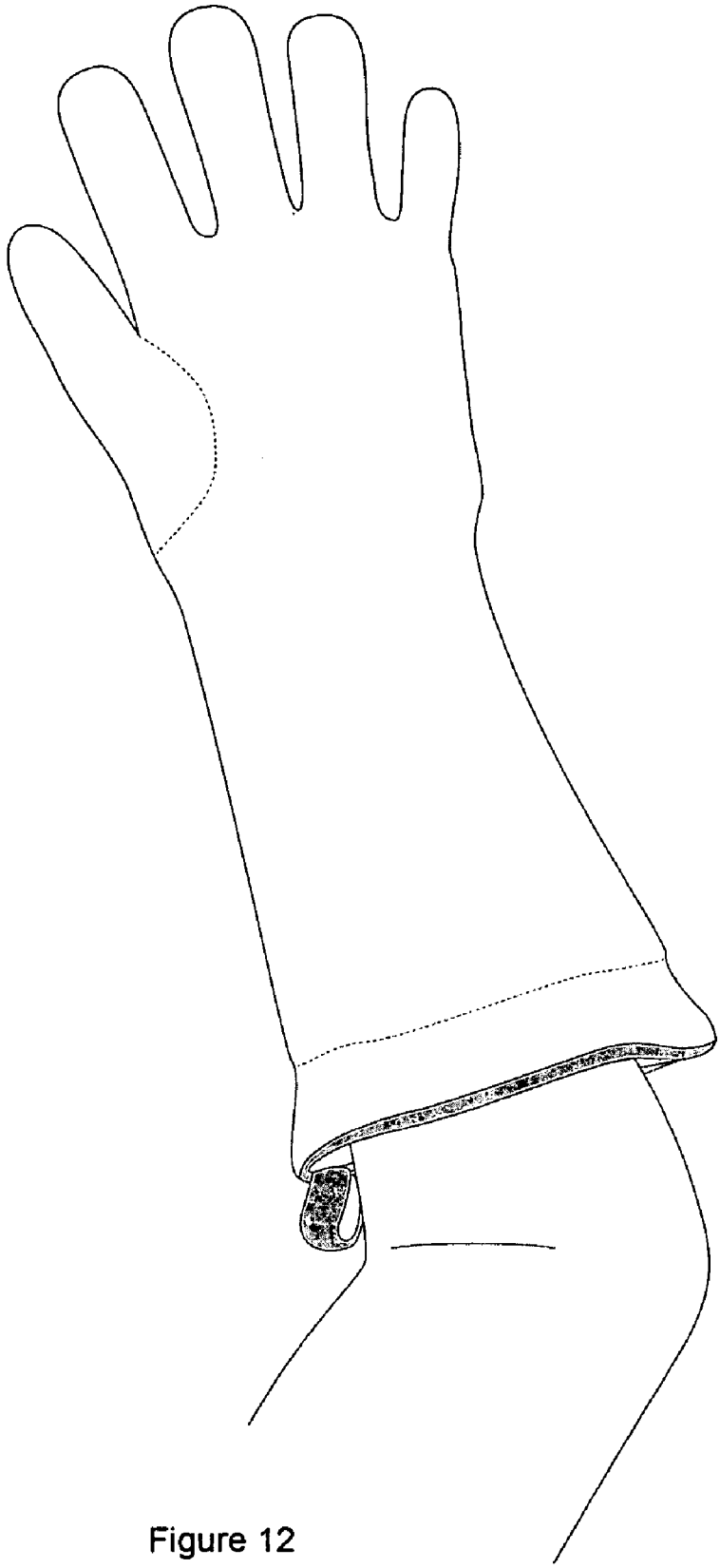
FIG. 12 illustrates some embodiment where sleeve of the glove extends beyond the wrist area.

As mentioned previously, some embodiments have varying sleeve sizes. FIG. 12 illustrates an embodiment where both outer and inner layers coextend beyond the wrist of user to about the elbow area. In other embodiments both outer and inner layers extend beyond the elbow area of user's arm to provide further utility for specialized jobs.

Several embodiments of the current invention are produced with varying structural specifications in order to satisfy different needs. For example, some embodiments are produced from only one layer of moisture absorbent material without the inner layer. Some embodiments are made with two layers, one outer layer and one inner layer. Materials for the inner layer comprise non-absorbent, non-porous, moisture-insulating, moisture-resistant, or moisture-repellent material. Purpose of the inner layer is to protect the inner space of the glove from the material coming in contact with outer layer, and to protect the user's hand. Yet another embodiment is made of several layers of material, possibly with an additional inner lining added for comfort. In some embodiments, the outer layer is made from several moisture-absorbent materials in order to enhance absorbency qualities of the current invention. A low cost embodiment is made of at least one layer of moisture absorbent paper (i.e., paper towel), hence producing a drying glove similar to the one illustrated in FIG. 5.

Hence, the reader can readily see that some embodiments of the drying glove of this invention can be used to dry objects and articles in the kitchen, home, garden, workplace, or elsewhere. It is easy and intuitive to use. It is simple and straightforward to manufacture. It enhances the security of the job of drying by means of allowing the user usage of both hands for the job at hand. It simplifies the job of drying by removing the risk of depositing fingerprints; smear marks, or other undesirable marks on the target article.

Several objects and advantages of some embodiments of the invention are enumerated here. However, objects and advantages are not limited to those mentioned. Further objects and advantages are to provide a glove that is used easily and conveniently to dry or polish any object, without depositing fingerprints or smear marks on the object, and to perform the job with security. A glove which is simple and inexpensive to manufacture; which is used to more conveniently perform other work that is usually done with a towel or a piece of cloth; and which obviates the need to use a simple rag with all of its shortcomings. Another object is to provide, in some embodiments of the current invention, a paper-towel drying glove made of absorbent paper or absorbent industrial paper material that performs all the aforementioned tasks, yet is cheaper and lighter. Still further objects and advantages are apparent from the description and drawings of some embodiments of the invention. However, objects and advantages of this invention are not limited to those enumerated in this document, and will be apparent to anyone with ordinary skill in the art.

As the attached drawings illustrate, the drying glove is simple in design, yet novel and original in purpose, as well as method of operation. While the present invention has been illustrated and described as embodied in a glove for drying, however, it is not limited to the details explained. It will be understood that various omissions, modifications, substitutions and changes in the forms and details of the device illustrated and its operation can be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A device for drying household items, the device comprising:

(a) an outer layer forming at least one pocket for receiving digits of a human hand, and (b) an inner layer permanently affixed to the outer layer in at least one location, said inner layer being completely enclosed by said outer layer, said inner layer defining at least one pocket for receiving the digits of the human hand, said outer layer comprising a palm portion covering the palm of the hand, said palm portion made of a moisture retentive material capable of drying a wet household item, said inner layer comprising a moisture resistant material, said inner layer and said outer layer each substantially encompassing the human hand.

2. The device of claim 1, wherein said outer layer and said inner layer each defines five pockets for receiving four fingers and a thumb.

3. The device of claim 1, wherein the outer layer further comprises a dorsal portion covering the back of the hand, said dorsal portion made of an abrasive material.

4. The device of claim 1, wherein material for said outer layer is terrycloth, wherein material for said inner layer is polyester.

5. The device of claim 1, wherein material for said outer layer is selected from the group comprising at least one of cotton, micro-fiber, absorbent paper, velvet, waffle-weave material, and pile fabric, wherein material for said inner layer is selected from the group comprising at least one of waterproofing treated polyester, rubber, nylon, plastic, vinyl, acrylic, rayon.

6. The device of claim 1 further comprising a sleeve that extends beyond wrist area of a hand of a user to about elbow area, wherein said sleeve has at least one layer, wherein said one layer comprising at least one of said outer layer and said inner layer.

7. The device of claim 2, wherein each layer further comprises:

(a) a palmar surface, and (b) a dorsal surface, wherein one of said pockets in each layer is for receiving a thumb, wherein the pocket for receiving the thumb in each layer is neutrally positioned between the palmar and the dorsal surfaces enabling the device to be reversible to be worn by either a right hand or a left hand.

* * * * *